US005447668A

United States Patent [19]

Delangis

[11] Patent Number: 5,447,668

[45] Date of Patent: Sep. 5, 1995

[54] METHOD AND APPARATUS FOR ELIMINATING FIBER DISTORTIONS AND SEPARATIONS IN METAL MATRIX MATERIALS

[75] Inventor: Leo M. Delangis, Lomita, Calif.

[73] Assignee: Rockwell International Corporation, Seal Beach, Calif.

[21] Appl. No.: 131,182

[22] Filed: Oct. 4, 1993

[51] Int. Cl.[6] ..... B29C 43/12

[52] U.S. Cl. ..... 264/101; 29/418; 29/419.1; 29/421.1; 156/286; 156/382; 264/102; 264/325; 425/388; 425/389; 425/405.2

[58] Field of Search ..... 264/101, 102, 325; 156/285, 382, 286; 425/405.2, 405.1, 389, 388, 508; 29/418, 419.1, 421.1

[56] References Cited

U.S. PATENT DOCUMENTS

| | | | |
|---|---|---|---|
| 4,065,340 | 12/1977 | Dickerson | 156/285 |
| 4,615,859 | 10/1986 | Traut | 264/101 |
| 4,855,011 | 8/1989 | Legge et al. | 425/405.2 |
| 5,122,318 | 6/1992 | Bonet | 425/389 |
| 5,137,663 | 8/1992 | Conaway | 425/405.2 |
| 5,145,621 | 9/1992 | Pratt | 156/285 |
| 5,236,646 | 8/1993 | Cochran et al. | 264/102 |

FOREIGN PATENT DOCUMENTS

| | | | |
|---|---|---|---|
| 61-277428 | 12/1986 | Japan | 156/285 |
| 661884 | 8/1987 | Switzerland | 425/405.2 |
| WO87/05557 | 9/1987 | WIPO | 156/285 |

*Primary Examiner*—Jeffery R. Thurlow
*Attorney, Agent, or Firm*—Terrell P. Lewis; Charles T. Silberberg

[57] ABSTRACT

Apparatus and a method are disclosed for eliminating fiber distortions ("fiber swimming") and separations ("fiber fish eyes") via a premliminary step taken prior to consolidation of "green", fiber-reinforced metal matrix materials. The apparatus includes a first member for supporting the "green" metal matrix material pack, a second member to cover the "green" pack, the thermal coefficient of expansion of the first member being smaller than the thermal coefficient of expansion of the second member, the second member being secured to the first member atop the "green" pack to form a retort, and the entire retort being heated to an off-gassing temperature, where the second member bows outwardly away from the pack to relieve pressure from the pack.

6 Claims, 2 Drawing Sheets

METHOD AND APPARATUS FOR ELIMINATING FIBER DISTORTIONS AND SEPARATIONS IN METAL MATRIX MATERIALS

STATEMENT OF GOVERNMENT INTEREST

This invention was made with Government support under Contract No. F33657-91-C-2012 awarded by the U.S. Air Force. The Government has certain rights in this invention.

BACKGROUND OF THE INVENTION

1. Field of the Invention

The present invention relates to methods and apparatus for minimizing Imperfections In consolidated composite materials, and more particularly to a method and apparatus for eliminating fiber distortions ("fiber swimming") and separations ("fiber fish eyes") via a preliminary step taken before consolidation of "green", fiber-reinforced titanium matrix materials.

2. Background of the Invention

In the current methods of fabrication of titanium matrix composite (TMC) components, layers of woven fiber mat and thin foils (typically on the order of 0.005" thick titanium alloy) are positioned atop one another to form a "green pack" (see 110 in FIG. 1 of the drawings) which will later be consolidated by Hot Isostatic Pressure (HIP) in a steel tool at elevated temperatures (on the order of about 1520° F.) and very high pressures.

To keep the foils and mats in place one atop another, an adhesive 120 is used to bond the foil and fiber mat layers. The "green pack" is placed in a recess of a stainless steel tool 130 and covered with a stainless steel sheet or "bladder" 140 that is welded to the tool. Stop-off compositions 150 often may also be used on the bladder surface facing the pack to help prevent sticking of the pack surfaces to the bladder. The volume between the tool and the bladder in which the pack is sealed from the atmosphere is commonly referred to as a "retort". The bladder is also designed to put positive pressure on the pack to prevent any internal movement during transportation and off-gassing. At a later time, during a "hipping" process, when a vacuum has been imposed in the retort, the bladder acts to apply pressure to the pack during its consolidation.

The off-gassing process involves subjecting the retort to elevated temperatures (on the order of about 850° F.) while impressing a vacuum in the retort. As a controlled amount of inert gas is passed through the retort, a "purging" takes place in which the adhesive and stop-off compositions, which have volatized during the off-gassing operation, are driven off. These substances, if not removed, would contaminate the foils and fiber mat to prevent consolidation.

During the off-gassing process, the bladder is pulled against the pack by vacuum pressure. This has the effect of restricting fiber movement, breaking cross weave, and pushing the fibers in the mat apart, thereby causing undesirable "fiber swimming" (see the areas designated 170 in FIG. 2 characterized by a wavy or non-linear extent of the fibers) and "fish eyes" (see the areas designated 180 in FIG. 2 characterized by localized separations of adjacent fibers). The introduction of the purging gas into the retort was thought to be of some assistance insofar as the bladder would be pushed away from, and out of contact with, the pack, but this has not corrected the problem. The resulting anomalies degrade the overall quality of the composite as well as its mechanical properties.

OBJECTS OF THE PRESENT INVENTION

It is therefore a primary object of the present invention to provide a method and an apparatus for optimizing reduction of fiber swimming and fish eye anomalies during the fabrication of titanium matrix composite components, while at the same time overcoming all the disadvantages and drawbacks of similar known fabrication techniques.

Another object of the present invention is to provide a method and apparatus for enabling evacuation of volatile by-products resulting from burnoff of the adhesive and/or stop off materials in the course of the off-gassing procedure while at the same time minimizing the occurence of fiber swimming and fish eyes in titanium metal matrix materials reinforced with fiber mat materials.

These and other objects and advantages are achieved with the method and apparatus of the present invention in which a "green pack" of composite materials is disposed within a tool of a material having a first coefficient of thermal expansion, i.e., a material such as low carbon steel, and is then covered with a sheet or "bladder" of a material having a second coefficient of thermal expansion, i.e., a material such as stainless steel, where the first coefficient of thermal expansion is less than the second coefficient of thermal expansion. The bladder is welded to the tool about the pack of composite material to form the retort, and a vacuum is created within the retort. Then, when the entire assembly is heated in the off-gassing procedure, the bladder experiences greater thermal expansion than the tool and thus deforms outwardly or "bubbles" away from the pack and tool thereby preventing the bladder from pressing on the pack and causing fish eye and fiber swimming anomalies.

DETAILED DESCRIPTION OF THE INVENTION

Figure 1:
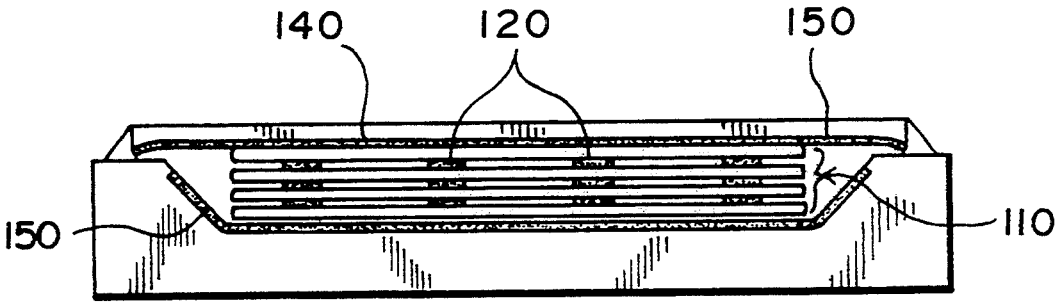
FIG. 1 illustrates an apparatus for effecting an off gassing procedure in accordance with known technology.
Figure 3:
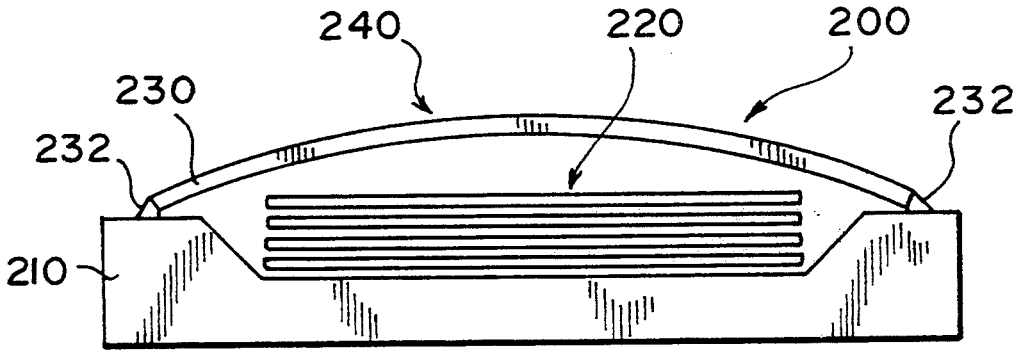
FIG. 3 illustrates an apparatus for effecting an off gassing procedure in accordance with the present invention.
Figure 2:
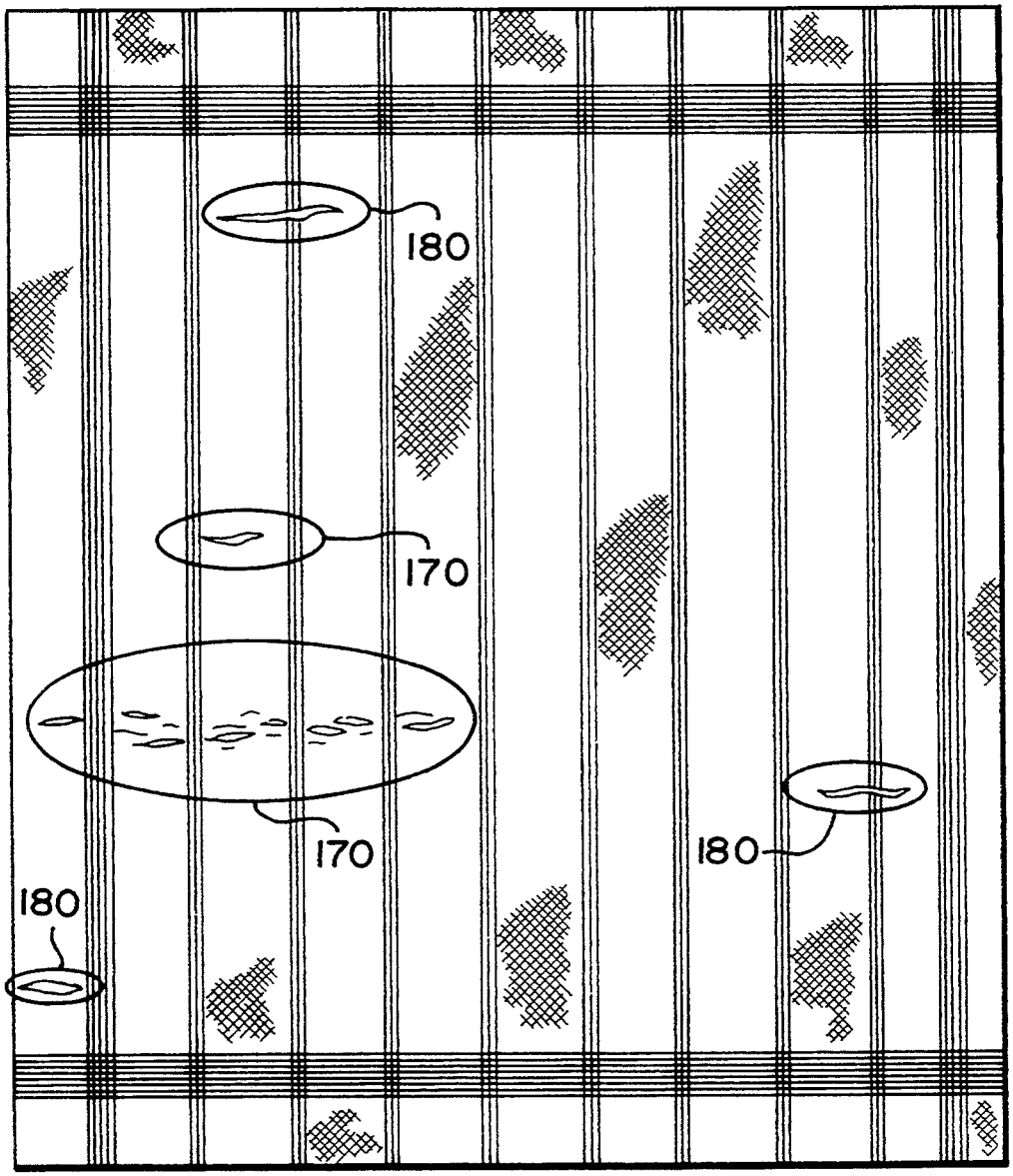
FIG. 2 shows the surface of a composite material pack which has undergone an off-gassing procedure using apparatus and methodology of the known technology.

Referring now to FIG. 3, the apparatus of the present invention, shown generally at 200, is shown to include a tool member 210 made of a material (preferably a metal such as low carbon steel) having a first coefficient of thermal expansion, a composite material "green pack" 220 disposed in a well formed in one surface of the tool member, and a bladder or covering sheet 230 (preferably a metal such as stainless steel) disposed atop the upper surface of the tool member over the "green pack" 220, and having a second coefficient of thermal expansion greater than the first coefficient of thermal expansion. The bladder is welded about its edges to the tool member (as shown at 232) to form a retort, with the "green pack" captured, but not pinned within, the retort. A vacuum is then created within the retort.

When the retort is heated to the temperature required to perform the off-gassing procedure, each of the bladder, tool member and "green pack" expand. The bladder expands more than the tool member, since the former has a coefficient of thermal expansion greater than the coefficient of thermal expansion of the latter. As a result, since it is pinned to the tool member at the weld seam, the greatest expansion of the bladder occurs at the central region such that the sheet bows outwardly away from the "green pack" (see 240 in FIG. 3) to relieve pressure on the composite material of the pack, thereby preventing impingement of the bladder on the "green pack" and the resulting formation of "fish eyes" and fiber-swimming.

While certain representative embodiments and details have been shown for the purpose of illustrating the invention, it will be apparent to those skilled in this art that various changes and modifications may be made therein without departing from the spirit or scope of this invention.

What we claim is:

1. An apparatus for performing an off-gassing procedure of a composite material "green pack" prior to consolidating the "green pack" in a hipping process, said apparatus comprising:

a first member adapted for supporting a "green pack" and being made of a material having a first coefficient of thermal expansion, a second member adapted to cover the "green pack" being supported on said first member, said second member being of a material having a second coefficient of thermal expansion, said first coefficient of thermal expansion being smaller than said second coefficient of thermal expansion, means for sealing said second member to said first member atop the "green pack" to form a retort, and means for impressing a vacuum in said retort, said second member, when heated to an off-gassing temperature, bowing outwardly away from said first member to relieve pressure from said "green pack", while allowing volatile contaminants to be purged from said retort.

2. The apparatus of claim 1, wherein said first member is a tool having a recess for the receipt of said "green pack", and said second member is a cover sheet for said tool.

3. The apparatus of claim 1, and further including means coupled with said retort for introducing a fluid through said retort to purge volatized substances from the interior of said retort after being heated to said off-gassing temperature.

4. The apparatus of claim 1, wherein the material of which said first member is comprised is low carbon steel, and the material of which said second member is comprised is stainless steel.

5. A method for performing an off-gassing procedure of a composite material "green pack" prior to consolidating the "green pack" in a hipping process, said method comprising:

placing said "green pack" in a tool having a first coefficient of thermal expansion, forming a retort containing said "green pack" by attaching a cover sheet having a second coefficient of thermal expansion atop said tool, said first coefficient of thermal expansion being smaller than said second coefficient of thermal expansion, creating a vacuum in said retort, moving a purging fluid into said retort, heating said retort to a temperature necessary to perform an off-gassing procedure, and performing said off-gassing procedure by maintaining said retort at said temperature such that volatized contaminants can be purged from said retort prior to performing the hipping process, said cover sheet expanding at a greater rate than, and thereby bowing away from, said tool member to relieve pressure on said "green pack" whereby fiber-swimming and fish eye anomalies are prevented.

6. The method of claim 5, wherein said step of forming said retort includes sealing said cover to said tool about the perimeter of said "green pack".

* * * * *